US008595908B2

(12) United States Patent
Cox et al.

(10) Patent No.: US 8,595,908 B2
(45) Date of Patent: Dec. 3, 2013

(54) CASKET ASSEMBLY WITH NESTING LIDS

(75) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 376 days.

(21) Appl. No.: 12/816,213

(22) Filed: Jun. 15, 2010

(65) Prior Publication Data

US 2010/0313396 A1 Dec. 16, 2010

Related U.S. Application Data

(60) Provisional application No. 61/186,941, filed on Jun. 15, 2009.

(51) Int. Cl.
*A61G 17/00* (2006.01)

(52) U.S. Cl.
USPC ..... 27/4; 27/14; 27/17; 27/27; 16/439; 229/117.09; 229/125.37; 229/199

(58) Field of Classification Search
USPC ..... 27/4, 14, 17, 19, 2, 27; 229/125.01, 229/199, 117.09, 939, 125.37; 16/424, 439
See application file for complete search history.

(56) References Cited

U.S. PATENT DOCUMENTS

| | | | | | |
|---|---|---|---|---|---|
| 1,807,770 | A * | 6/1931 | Beaman | 27/35 |
| 3,490,114 | A * | 1/1970 | Connelly et al. | 27/2 |
| 3,782,619 | A * | 1/1974 | Dittbenner | 206/527 |
| 4,156,956 | A * | 6/1979 | Partridge et al. | 27/4 |
| 4,253,206 | A * | 3/1981 | Cherry | 5/600 |
| 4,730,370 | A * | 3/1988 | Elder | 27/4 |
| 4,773,134 | A * | 9/1988 | Kay | 27/14 |
| 4,788,757 | A * | 12/1988 | Bethune et al. | 27/2 |
| 4,944,076 | A * | 7/1990 | Kay et al. | 27/14 |
| 5,307,545 | A * | 5/1994 | Stoltz | 27/4 |
| 5,775,061 | A * | 7/1998 | Enneking et al. | 53/445 |
| 5,974,640 | A * | 11/1999 | Vosahlik et al. | 27/2 |
| 6,145,175 | A * | 11/2000 | Enneking et al. | 27/4 |
| 6,154,937 | A * | 12/2000 | Enneking et al. | 27/2 |
| 7,003,855 | B2 * | 2/2006 | Lew | 27/4 |
| 2005/0028333 | A1 * | 2/2005 | Vosahlik et al. | 27/14 |
| 2009/0235491 | A1 | 9/2009 | Cox | |

* cited by examiner

*Primary Examiner* — William Miller
(74) *Attorney, Agent, or Firm* — Maginot, Moore & Beck

(57) ABSTRACT

A casket includes a lid and a container. The container is configured to receive the lid in a first configuration for shipping, and in a second configuration for funereal purposes. In general, the lid in the first configuration is detached and inverted with respect to the second configuration, particularly when the lid is closed in the second configuration.

20 Claims, 11 Drawing Sheets

CASKET ASSEMBLY WITH NESTING LIDS

This application claims the benefit of U.S. Provisional Patent Application Ser. No. 61/186,941, filed Jun. 15, 2009, which is incorporated herein by reference.

FIELD OF THE INVENTION

The present invention relates to caskets.

BACKGROUND OF THE INVENTION

Caskets can be employed for both display and interment of a deceased. Because of the display aspect, a casket must convey dignity and respect for the deceased. To accomplish the foregoing, it is known to manufacture caskets from hardwoods and metal materials, and providing them with decorative features. However, the cost of such caskets can be beyond the reach of many.

Accordingly, caskets formed of corrugated paperboard and/or manufactured wood products have been developed. Such products can be manufactured at a much lower cost than the hardwood and metal caskets. However, significant costs remain in both material and shipment of caskets made from lower cost materials.

SUMMARY OF THE INVENTION

Embodiments of caskets disclosed herein include several features that can lower the cost of manufacture and/or shipment of the casket. It will be appreciated that savings can be obtained even if less than all of the novel features disclosed herein are employed.

In general, an embodiment of a casket includes a lid and a container. The container is configured to receive the lid in a first configuration for shipping, and in a second configuration for funereal purposes. In general, the lid in the first configuration is detached and inverted with respect to the second configuration, particularly when the lid is closed in the second configuration.

Other inventive aspects of the embodiments disclosed herein include a latch system for a removable and invertible lid for a casket, a body construction for a lightweight casket, a lid construction for a lightweight casket, and a decorative bridge/cover for inner edge of a partial lid of a casket. Other features and advantages will become more readily apparent to those of ordinary skill in the art by reference to the following detailed description and accompanying drawings.

DETAILED DESCRIPTION

Figure 1:
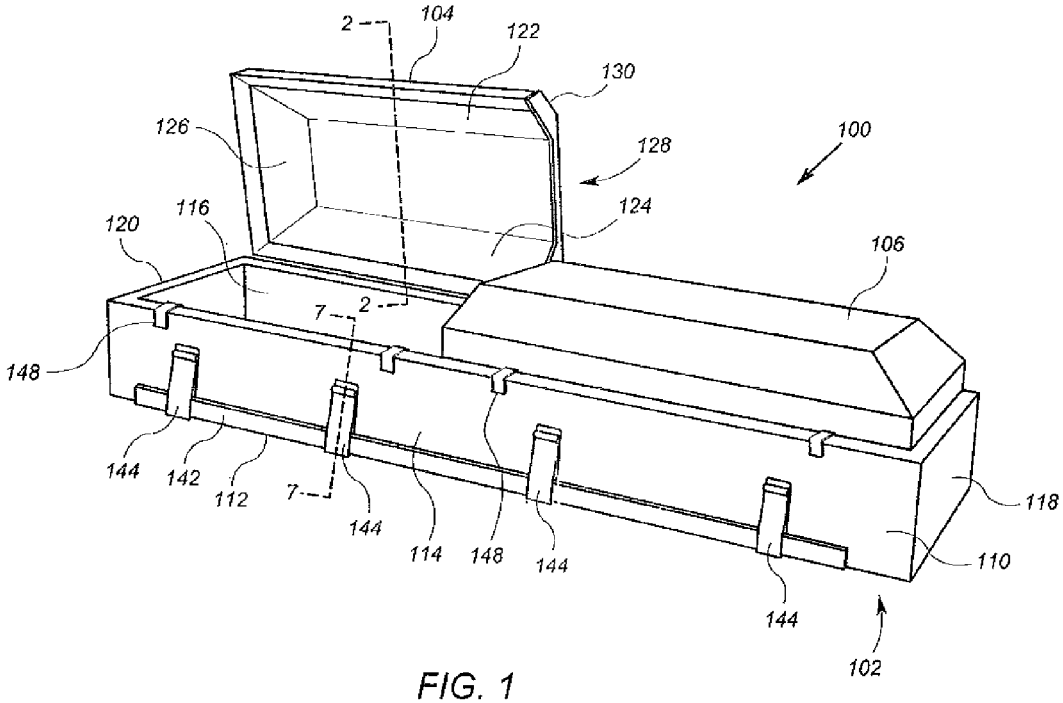
FIG. 1 shows a perspective view of an exemplary casket that incorporates multiple features.

FIG. 1 shows a perspective view of an exemplary casket 100 that incorporates multiple inventive features. The casket 100 includes a body assembly 102 and first and second lid portions 104 and 106, respectively. As shown in FIG. 1, the body assembly 102 includes a box structure 110 and a handle assembly 112. The body assembly 102 further includes interior features not shown in FIG. 1. Further detail regarding such features, including side supports 610, 612, is provided below in connection with FIGS. 6 and 7.

In FIG. 1, the first lid portion 104 is partly removed to show some of the underlying features thereof. It will be appreciated that the first lid portion 104 and the second lid portion 106 may be essentially identical in construction, although the lengths of the first and second lid portions 104, 106 may differ from each other as a matter of preference.

The box structure 110 includes a first side wall 114, a second opposite side wall 116, a first end wall 118, a second opposite end wall 120, and a bottom panel, not shown in FIG. 1. (See, e.g. bottom panel 119 of FIG. 6). The first side wall 114 and the second side wall 116 have elongated sides compared to the end walls 118, 120, thereby defining a substantially rectangular box. The bottom panel 119 (FIG. 6) intersects with both side walls 114 and end walls 116 to form the open-topped box structure 110. The side walls 114, 116 and end walls 118, 120 are preferably formed from at least two layers of kraft paper or corrugated paper. The bottom panel 119 is similarly formed at least in part by kraft or corrugated paper. However, the bottom panel may also include a plywood or particle board reinforcement. Further detail regarding an exemplary embodiment of the side wall 114 and the bottom panel 119 are shown in cross-section in FIG. 7.

The handle assembly 112 that includes a bar 142 and a plurality of rotatable hinge assemblies 144. In general, the handle assembly 112 is configured such that the bar 142 can rotate partly upward and outward to facilitate carrying of the casket 100. Further detail regarding the handle assembly 112 is provided below in connection with FIG. 7.

Figure 8A:
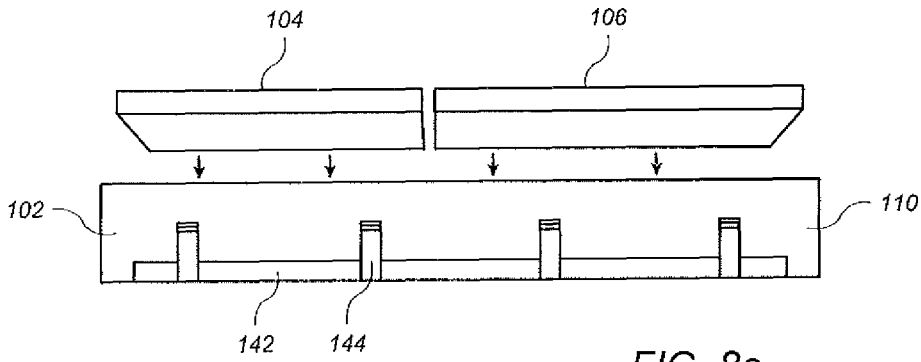
FIG. 8*a* shows a plan view of the casket of FIG. 1 readied for placement into a shipping configuration.
Figure 8B:
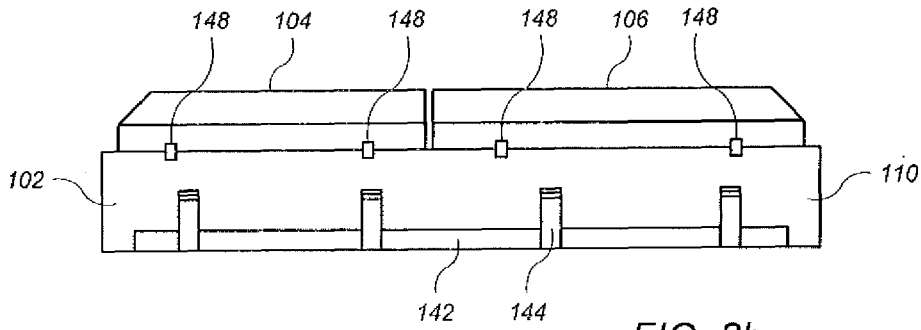
FIG. 8*b* shows a plan view of the casket of FIG. 1 configured for end use.

Similarly, the first and second lid portions 104, 106 are formed by multilayer corrugated paper having appropriate bends to provide the contoured shape shown in FIG. 1. The contoured shape allows for an aesthetically pleasing shape, and also allows for the shipping of the lid portion 104 and 106 in inverted position for shipment without interfering with reinforcement structures such as the side supports 610, 612. FIGS. 8*a* and 8*b*, discussed further below, illustrate how the lid portions 104 and 106 may be inverted for shipment.

In this embodiment of the contoured lid shape, the first lid portion 104 includes two inclined side portions 122, 124, a top portion 125, an inclined end portion 126, and an inward edge 128. The two inclined side portions 122, 124 and the inclined end portion 126 extend inward and upward generally from respective the edges to the top portion 125, forming part of a truncated pyramid structure, thereby defining the contoured shape.

Figure 2:
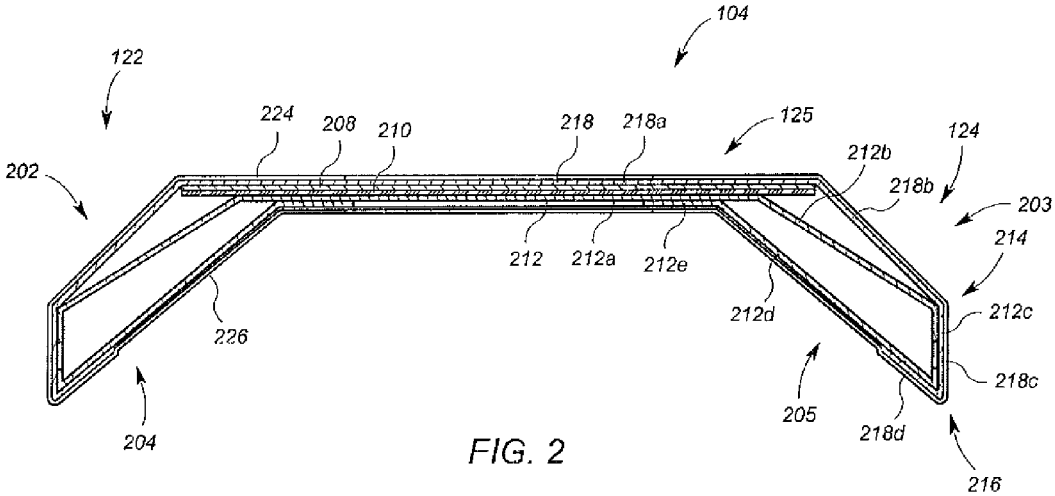
FIG. 2 shows a cutaway view of a first lid of the casket of FIG. 1.

In particular, as shown in FIG. 2, the inclined side portion 122 includes a top incline surface 202, and a bottom incline surface 204. In this embodiment the bottom incline surface 204 is slightly longer and extends in a slightly less inclined angle than the top inclined surface 202. As a consequence, the inclined side portion 122 gets slightly thicker as it progress upward toward the top portion 125. The other inclined side portion 124 has a similar structure, having a corresponding top incline surface 203 and a corresponding bottom incline surface 205.

To achieve a cost-effective and sturdy lid having the desired shape, the exemplary construction of the first lid portion 104 shown in cross-section in FIG. 2 may be advantageously employed. The first lid portion 104 first and second interior layers 208, 210, respectively, that generally form the "backbone" of the top panel 128. The layer 208, 210 may suitably be formed of corrugated paper. Positioned below the second interior layer 210 is a shaping piece 212, formed of a single piece of corrugated paper folded into sections, including the sections 212*a*-212*e* discussed below. Another shaping piece 218 is disposed in part above the first interior layer 208. Similar to the shaping piece 212, the shaping piece 218 is a single piece of corrugated paper folded into sections, discussed further below.

In particular, the shaping piece includes a central section 212*a* that extends adjacent to, and just short of the ends of, the second interior layer 210. The shaping piece 212 also includes a first inclined portion 212*b* that extends at first angle from horizontal from near one end of the second interior layer 210 to a first corner area 214. The shaping piece 212 includes a vertical piece 212*c* that extends from the first corner area 214 to a second corner area 216. Extending from the end of the vertical piece 212*c* is second inclined portion 212*d* that extends at a second angle from the horizontal, less than the first angle, to a point adjacent the central section 212*a* that is inward of, but close to, the end of the central section 212*a* at which the first inclined portion 212*b* begins. Extending from the resulting end of the second inclined portion 212*d* is a short horizontal run 212*e* that extends adjacent to and below a portion of the central section 212*a*. In this structure, it can be seen that the second inclined portion 212*d* defines the shape of the bottom incline side surface 205 of the inclined side portion 124 of the first lid 104.

The shaping piece 212 further includes symmetrical structures to the structures 212*b*-212*e* on the opposing side forming the other incline portion 122 of the first lid. Such structures have a substantially identical, but minor image construction as that of the structures 212*b*-212*e*. These structures similarly define the bottom incline surface 204 of the other incline side portion 122 of the first lid 104.

The upper shaping piece 218 includes a central section 218*a* that extends adjacent to, and substantially coextensively with, the first interior layer 208. The shaping piece 218 also includes a first inclined portion 218*b* that extends at a third angle from horizontal from the end of the first interior layer 210 to the first corner area 214. The third angle is greater than both the first and second angles of inclination of sections 212*b* and 212*d*. The shaping piece 218 includes a vertical piece 218*c* that extends from the first corner area 214 to the second corner area 216. The vertical piece 218*c* runs coextensively with and adjacent to the vertical piece 212*c* of the other shaping piece 212. Extending from the end of the vertical piece 218*c* is second inclined portion 218*d* that extends at a second angle from the horizontal, and adjacent to the second inclined portion 212*d* of the shaping piece 212. The second inclined portion 218*d* only extends less than half of the overall extent of the second inclined portion 212*d*, and then terminates. In this structure, it can be seen that the first inclined portion 218*b* defines the shape of the top incline side surface 203 of the inclined side portion 124 of the first lid 104.

The shaping piece 218 further includes symmetrical structures to the structures 218*b*-218*d* on the opposing side forming the other incline portion 122 of the first lid 104. Such structures have a substantially identical, but minor image construction as that of the structures 218*b*-218*d*. These structures similarly define the top incline surface 202 of the other incline side portion 122 of the first lid 104.

It can thus be appreciated that that the shaping pieces 212 and 218 effectively define the shape of the first lid 104, with the exception of the end inclined portion 126. The end inclined portion 126 may suitably be formed with similar structures as those of the inclined portions 122 and 124. In such a case, the first and second interior layers 208 and 212 may be formed to have ends that fold similar to the shaping pieces 212 and 218. These folded ends, not shown, create shaping pieces for the end inclined portion 126, similar to pieces 212 and 218.

The first lid 104 also includes a first fabric wrap 224 that covers, is adjacent to, and extends substantially completely around the upper surface of the support structure 218. A second, thinner fabric piece 226 covers otherwise uncovered portions of the lower support structure 212 such that the fabric 224, 226 cooperate to extend around the entire cross section of the first lid 104 as shown in FIG. 2.

Referring again to FIG. 1, the inward edge 128 of the first lid 104, which has a planar face, includes a bridge assembly 130. The bridge assembly 130 extends over exposed edges of the corrugated paper that form the pieces 208, 210, 212 and 218 of the first lid 104. While the other edges are covered by the fabric 224 and 226, the inward edge 128 of the first lid 104 is covered by the bridge assembly 130. The corresponding inward edge of the second lid 106 is covered by a similar assembly.

Figure 3:
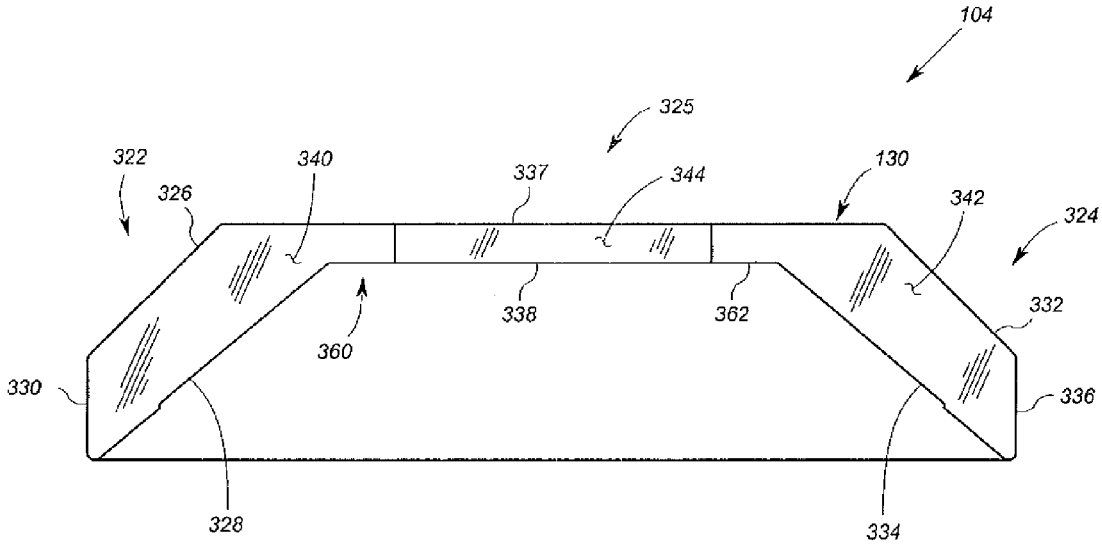
FIG. 3 shows a plan view of the lid of FIG. 2.

FIG. 3 shows an end plan view of the first lid 104 facing the inward edge 128, which shows the bridge assembly 130 in further detail. In general, the cover assembly is configured to adapt to the cutaway profile of the first lid 104, as illustrated in FIG. 2. Such a configuration both adequately covers the exposed edges of the paper (or other material) pieces 208, 210, 212 and 218 without compromising the vertical clearance available for the midsection of the deceased.

Accordingly, the bridge assembly 130 includes, analogous to the first lid 104 itself, a first inclined portion 322, a second inclined portion 324 and a top portion 325. The first inclined portion 322 includes an upper inclined edge 326 and a lower inclined edge 328. The upper incline edge 326 has a greater angle of inclination from the horizontal dimension of the top portion 325. A short vertical edge 330 defines the outer horizontal edge of the bridge assembly 130 and extends from the end of the upper inclined edge 326 to the end of the lower inclined edge 328. The second inclined portion 324 includes an upper inclined edge 332 and a lower inclined edge 334. As with the edges 326, 328, the upper incline edge 332 has a greater angle of inclination from the horizontal than does the lower inclined edge 334. A short vertical edge 336 defines the outer horizontal edge of the bridge assembly 130 and extends from the end of the upper inclined edge 332 to the end of the lower inclined edge 334.

The top portion 325 of the bridge assembly 130 includes an upper edge 337 and a lower edge 338, each of which extend between the respective upper and interior ends of the inclined portions 322 and 324. In this embodiment, the edges 337, 338 are horizontal. However, it will be appreciated that other shapes may be used, so long as the edges of the structural pieces (e.g. corrugated pieces 208, 210 etc. in the embodiment of FIG. 2) are covered.

In the embodiment described herein, the bridge assembly 130 includes the additional feature of having a modular construction. For example, in FIG. 3, the modular cover assembly includes two end pieces 340, 342 and a center piece 344 that may be assembled in to the structure of the bridge assembly 130 shown in FIG. 3. The end piece 340 includes the first inclined portion 322 and a small horizontal end extension 360 that forms a part of the top portion 325. Similarly, the end piece 340 includes the second inclined portion 324 and a small horizontal end extension 362 that forms an opposite end of the top portion 325. The center piece 344 defines a central portion of the top portion 325, and is configured to connect or meet with the end extensions 360, 362.

Figure 4:
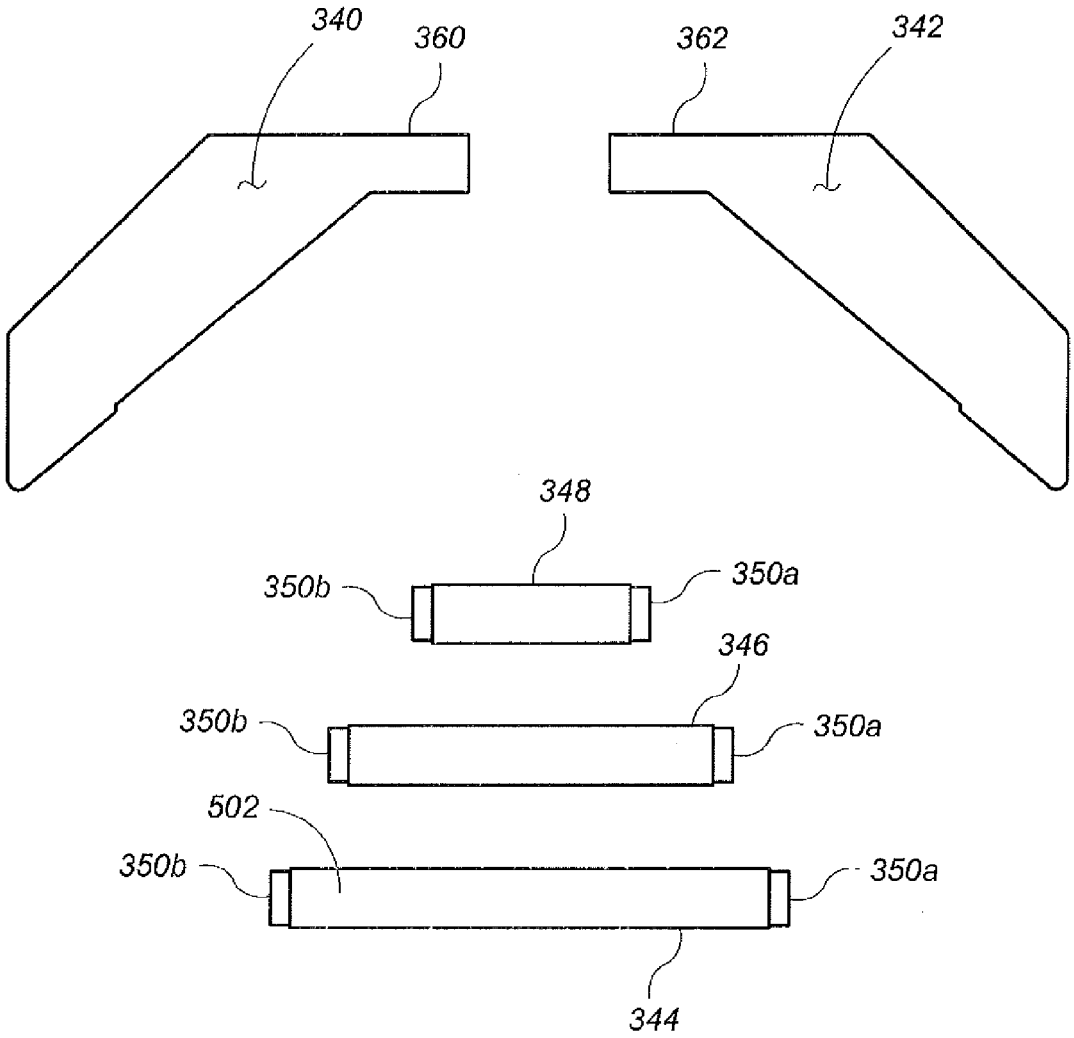
FIG. 4 shows a plan view of exemplary modular components of a bridge assembly for a casket according to embodiments of the invention.

The modular construction of the bridge assembly 130 facilitates molding, and in addition, the use of multiple casket widths. In particular, it is sometimes advantageous to provide caskets of different widths to accommodate deceased of different sizes. In the embodiment described here, the bridge assembly 130 is configured such that the center piece 344 may be replaced by a similar center piece of different length to accommodate different casket widths. Referring to FIG. 4, the pieces 340, 342 and 344 are shown in disassembled fashion, along with two alternative center pieces 346 and 348. The center pieces 344, 346 and 348 have different lengths. When a casket is constructed, a suitable one of the center pieces 344, 346 and 348 is chosen and connected to the end pieces 340, 342 to form the bridge assembly 130. The resulting bridge assembly 130 is then attached to the end of the corresponding lid (e.g. lid 104) using adhesive.

Figure 5B:
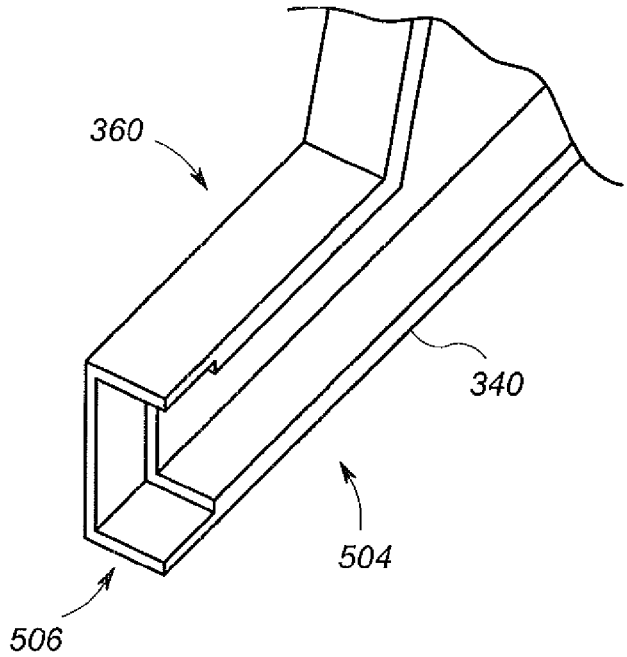
FIG. 5*b* shows a perspective view of another modular component of the bridge assembly of FIG. 4.
Figure 5A:
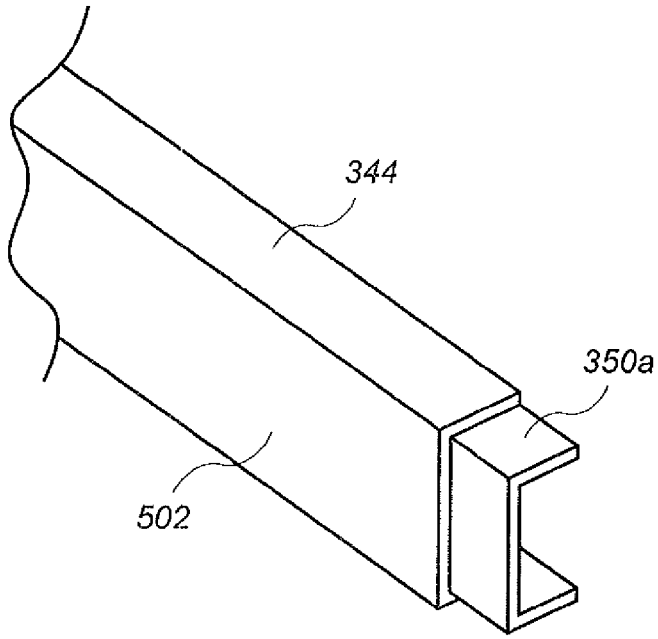
FIG. 5*a* shows a perspective view of a modular component of the bridge assembly of FIG. 4.

To construct the assembly 130, each of the center pieces 344, 346 and 348 includes opposing end tabs 350*a*, 350*b* that are configured to be received into suitable receptacles in the respective extensions 360, 362 of the end pieces 340, 342. In particular, FIGS. 5*a* and 5*b* show, respectively, a fragmentary perspective view of the outer surface 502 of the center piece 344 and a fragmentary perspective view of the underside 504 of the end piece 340. Both the center piece 344 and the end piece have a generally C-shaped cross-section. The tab 350*a* also has a C-shaped cross section, but also has a slightly reduced outer surface size as compared to the remainder the center piece 344. Conversely, an end section forming a socket or receptacle 506 of the end piece 340 has a cutout portion on the inside, such that the inner surface of the receptacle 506 is slightly larger than the inner surface of the remainder of the interior of the end piece 504. In addition, the receptacle 506 is sized to receive the tab 350*a* in a friction fit. Due to the reduced nature of the outer surface of the tab 350*a*, the outer surface 502 of the center piece 344 is substantially flush with the corresponding outer surface of the end piece 340 when the tab 350*a* is inserted into the receptacle 506.

It will be appreciated that the other end piece 342 and the other center pieces 346 and 348 have corresponding structures for assembly into corresponding finished bridges. One of the advantages of the modular nature of the bridge assembly 130 is the reduced inconvenience that otherwise would result from stocking and molding the entire integral bridge assembly 130 in three sizes. The modular design provides convenience in that it is more cost effective to mold and stock three different sizes of center pieces 344, 346 and 348 as opposed to three different sizes of entire integral bridge assemblies. It will be readily apparent that more or fewer sizes of center pieces may be employed.

Figure 6:
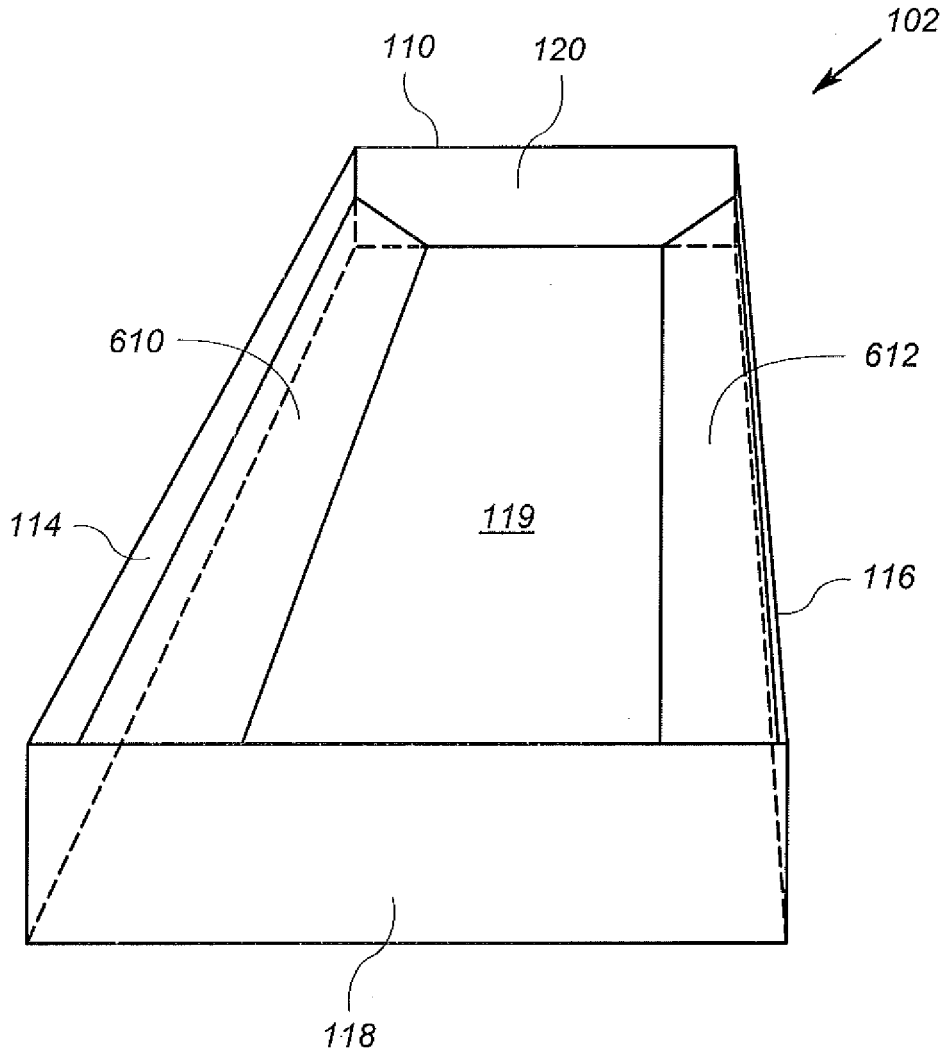
FIG. 6 shows a perspective view of the box structure of the casket of FIG. 1.

Another feature in the exemplary casket 100 is the main body structure. FIG. 6 shows a perspective view of the structure of the body structure 102 apart from the lids 104, 106. As discussed further above, the body structure 102 includes a box 110 having two elongate side walls 114, 116, two end walls 118, 120 and a bottom wall 119. As also shown in FIG. 6, the body structure 102 includes a pair of side supports 610, 612 formed preferably of folded-over corrugated paper. Each of the side supports 610, 612 is preferably in the form of a triangular tube having a length that extends along substantially the entire interior length of a corresponding side wall 114, 116. Each tube 610 has a height that is approximate one-half of the height of the side walls 114, 116, and a similar width. As such, side supports 610, 612 form a sort of fillet that provides support to the overall structure and facilitates the movement of interior elements of the handle assembly 112, not shown in FIG. 6.

Figure 7:
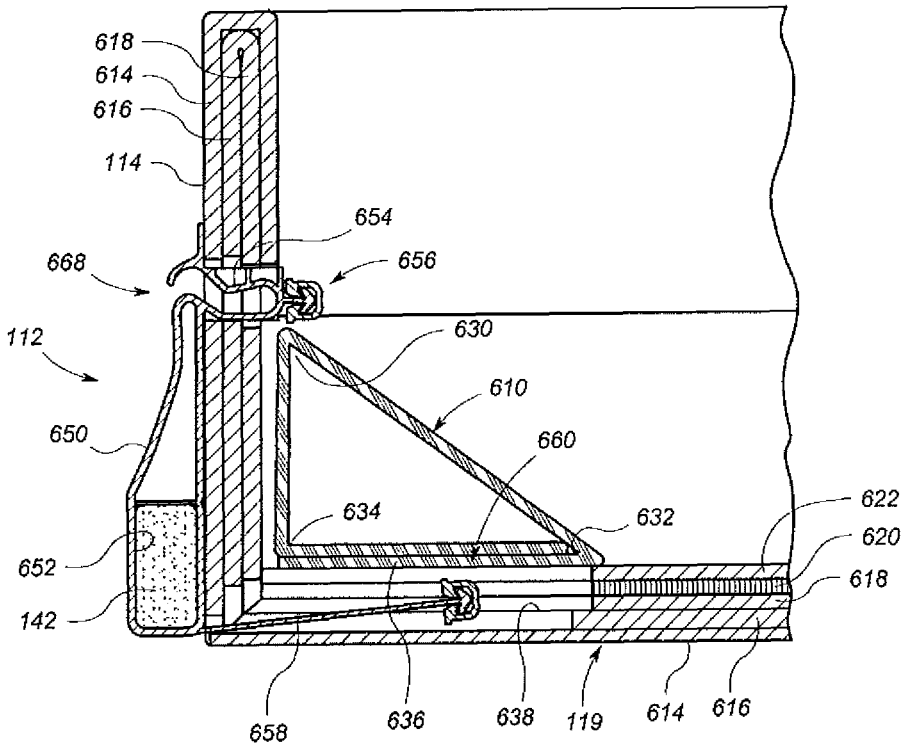
FIG. 7 shows a fragmentary cutaway view of an exemplary embodiment of the casket of FIG. 1.

FIG. 7 shows a cross section of a fragmentary portion of the sidewall 114, the side support 610, the handle assembly 112, and the bottom wall 119 as illustrated in FIG. 1 (although the bottom wall 119 is not visible in FIG. 1). As shown in FIG. 7, the side wall 114 includes multiple layers of corrugated paperboard. The three layers 614, 616 and 618 form the outermost layers of both the side wall 114 and the bottom wall 119 (and the opposing side wall 116, not shown in FIG. 7). The top two layers 620, 622 of the bottom wall 119 may also be folded at the ends to form, at least in part, the end walls 118 and 120, also not shown in FIG. 7.

In the particular orthogonal slice shown in FIG. 7, parts of the layers 614, 616, 618, 620 and 622 have been removed to form voids (e.g. void 638) to accommodate interior portions of the handle assembly 112. In other orthogonal slices, where the handle hinge assembly 144 is not present, the layers 614, 616 and 618 will extend continuously down the side wall 114 and across the bottom panel 119.

In any event, it will be appreciated that additional layers exclusive to the side wall 114 and/or bottom panel 119 may be employed.

As shown in FIG. 7, the side support 610 is formed a single piece of folded corrugated folded three times at fold points 630, 632 and 634 to form a triangular cross section with one overlapping leg 636. The bottom of the side support 610 rests on the panel 119, and thereby forms a top wall of the void 638 formed by the cutouts in the layers 614, 616, 618, 620 and 622.

The hinge assembly 144 includes an arm 650 having a handle receptacle 652, a hinge portion 654, first anchor assembly 656, a sliding arm 658 and second anchor assembly 660. The general construction and operation of the first anchor assembly 656, the second anchor assembly 660, the hinge portion 654 and the sliding arm 658 is described in detail in U.S. patent application Ser. No. 12/383,121, which is incorporated herein by reference. In particular, FIGS. 17 and 18 of U.S. patent application Ser. No. 12/383,121 show a similar construction, with the main difference being the arm 650 (and handle receptacle 652) of the instant FIG. 7, which is integrally formed with the first anchor assembly 656, the hinge portion 654, the sliding arm 658 and the second anchor assembly 660. Another difference is the hinge portion 654, which includes an outward facing C-shaped structure 660 that accommodates upward rotational movement of the arm 650. Otherwise, the construction and theory of operation of the hinge assembly 144 would be readily apparent from the above description, FIG. 7 and the application Ser. No. 12/383,121.

One of the features of at least some embodiments of the invention is that empty caskets 100 may be shipped in a second configuration that is not used when a deceased is disposed within the casket. In particular, for shipment the lids 104, 106 may be inverted and place substantially entirely or at least mostly within the interior of the box 110, oro in other words, mostly below the highest level of the side walls 114, 116 and end walls 118, 120. FIG. 8*a* shows the lids 104, 106 inverted and aligned to be placed downward into the interior of the body structure 102. Shipment in this configuration is cost-effective because the space consumed by the casket 110 during shipment is reduced.

To accommodate the inverted lids 104, 106 within the body structure 102, the width of each lid 104, 106, from side to side, must be slightly less than the interior distance between the side walls 114 and 116. Similarly, the combined lengths of the lids 104, 106 must slightly less than the interior distance between the end walls 118, 120. With such dimensions, the lids 104, 106 of FIG. 8*a* may be lowered into the interior of the body structure 102. Moreover, the angled nature of the side supports 160, 162 (see FIGS. 6, 7) accommodates the inclined portions 122, 124 of the lid 104 (see FIGS. 1, 2) and corresponding inclined portions of the lid 106.

When the casket 100 is used to house a deceased, the lids 104 and 106 are configured in the first configuration, shown in FIG. 8*b*. In the first configuration, the lids 104 and 106 are placed in the upright position over the body structure 102.

It can therefore be seen that the combination of the shape of the lids 104, 106, the size of the lids 104, 106 and the height of the body structure 102 allow for more cost effective shipping of a casket that also has an attractive, aesthetically pleasing appearance when used.

Referring to FIGS. 1 and 8*b*. The casket 100 further includes a plurality of clips 148 that are configured to secure the lids 104, 106 in the upright position shown in FIG. 8*b*. In particular, because the lids 104, 106 are sized to fit within the interior of the body structure 102 in the shipping configuration, the clips 148 are necessary to hold the lids 104, 106 from advancing significantly into the interior of the body 102. Specifically, the clips 148 are configured to hold the lids 104, 106 in a predetermined position with respect to the body structure 102.

Figure 9A:
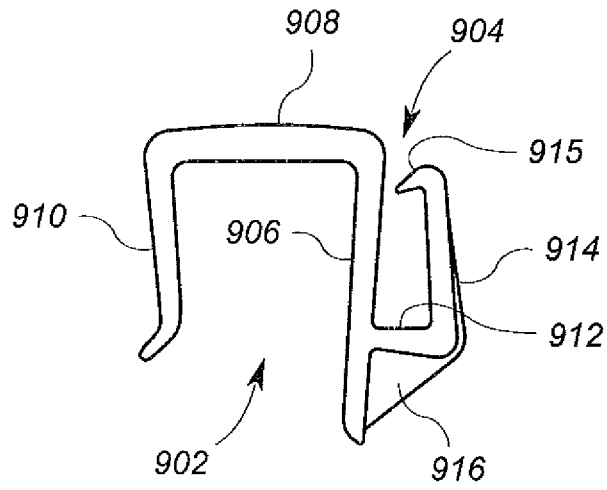
FIGS. 9*a* and 9*b* show different views of an exemplary embodiment of a clip for use with the casket of FIG. 1.
Figure 9B:
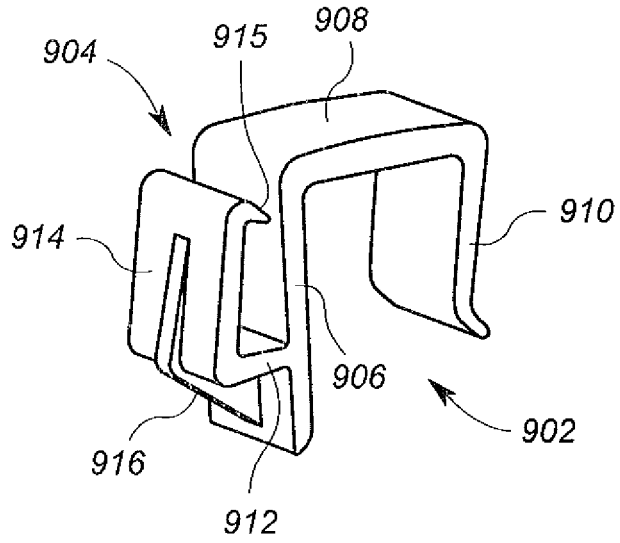

FIGS. 9*a* and 9*b* show different views of an exemplary clip 148 that may be employed. The clip 148 includes a casket seating structure 902 and a lid retaining structure 904. The casket seating structure 902 includes an inverted U-shaped plastic element designed to fit over the top of either of the sidewalls 114, 116. The lid retaining structure 904 includes an upright U-shaped element configured to receive a portion of the lid 104 (or 106), and is integrally formed with the casket seating structure 902.

In further detail, The U-shaped element of the casket seating structure 902 includes a main arm 906, a top 908 extending in a perpendicular fashion from the top of the main arm 906, and a retainer 910 extending downward from the top 908 in a manner that is substantially parallel to and spaced apart from the main arm 906. The lid retaining structure 904 includes an arm 912 that extends in a perpendicular manner from a location between the ends of the main arm 906, and in a direction opposite that from which the top 908 extends. The lid retaining structure 904 includes an upright 914 that extends upward from the arm 912 in a manner that is substantially parallel to and spaced apart from the main arm 906. The lid retaining structure 904 further includes a small barb that extends from the end of the upright 914 back toward the main arm 906. The clip 148 may further include a support rib 916 that extends from the bottom of the main arm 906 outward an upward to the at least the arm 912

Figure 10:
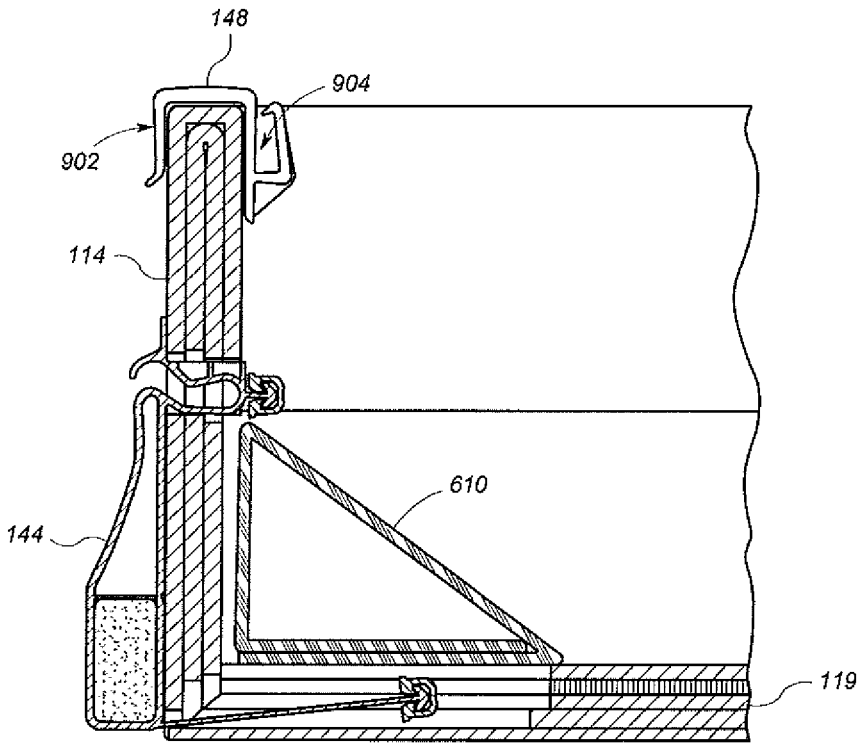
FIG. 10 shows a fragmentary cutaway view of a portion of the casket of FIG. 1 with the clip of FIG. 9*a* assembled thereon.
Figure 11:
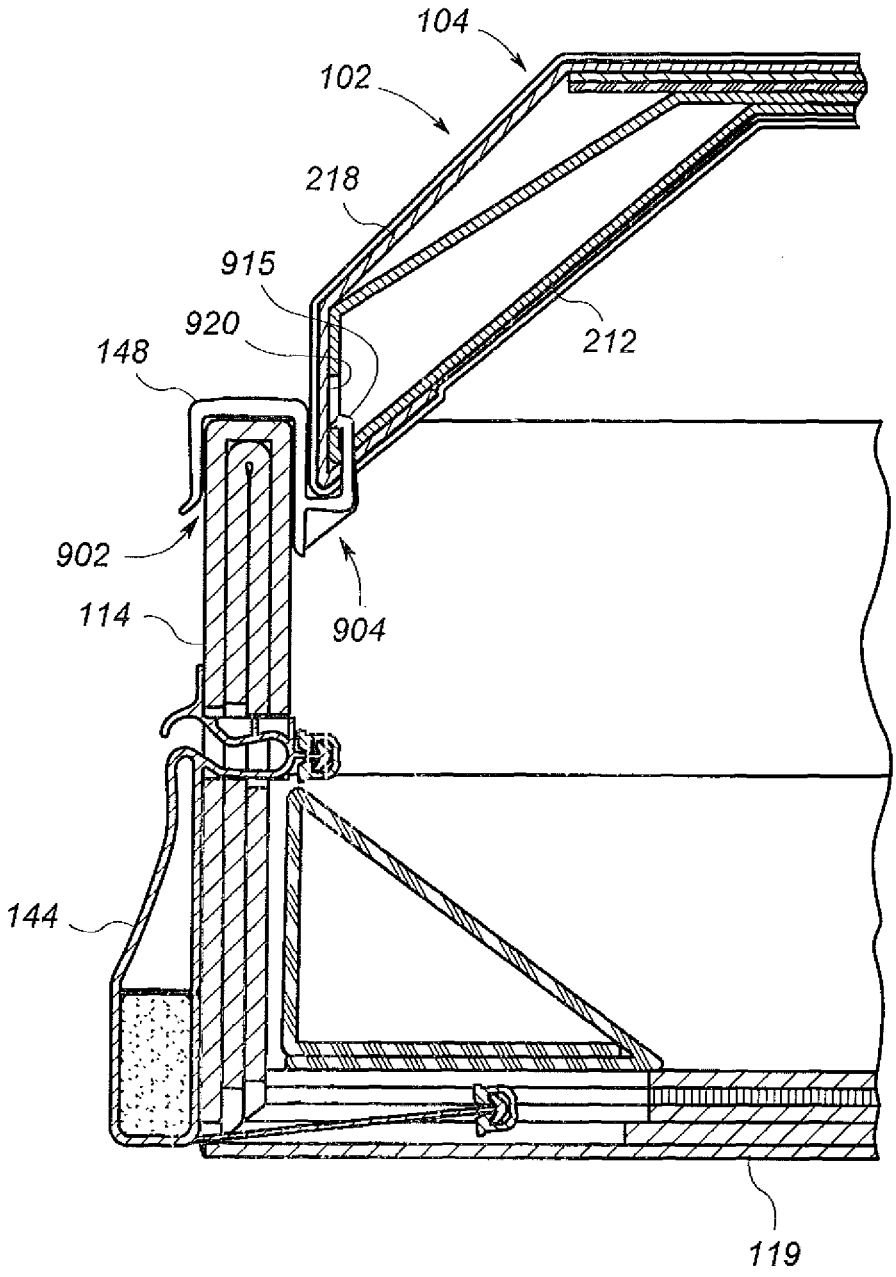
FIG. 11 shows a fragmentary cutaway view of a portion of the casket of FIGS. 1 and 8*b*.

FIG. 10 illustrates how the casket seating structure 902 of the clip 148 of FIGS. 9*a* and 9*b* is inserted onto the side wall 114 of the casket body structure 102. FIG. 11 shows how the lid 104 is inserted into the lid retaining structure 904 of the clip 148. It is noted that the lower 212 preferably includes a cutout 920 for receiving the barb 915 of the clip 148 to hold the lid 104 in place.

It will be appreciate that the above-described embodiments are merely illustrative, and that those of ordinary skill in the art may readily devise their own modifications and implementations that incorporate the principles of the present invention and fall within the spirit and scope thereof. For example, it will be appreciated that the bridge assembly 130 may employ a different connection scheme between the modular components than that shown in FIGS. 4, 5*a*, 5*b*. In another example, the contour of the lids 104, 106 may vary to have different designs. Preferably, however, such alternative lids would have a shape that ascends in some manner from the edges near the side walls 114, 116 toward the middle, thereby providing clearance for the deceased while nevertheless accommodating some form of the side supports 160, 162 when such lids are inverted and stowed within the casket.

It will further be appreciated that at least some of the advantages of the embodiments described herein may be obtained in alternative embodiments that do not have others of the advantageous features. For example, a casket with a single lid design may not require the bridge assembly 130, but may incorporate any of the other features such as the side supports, general lid design, and nesting features. Similarly, a non-nesting lid having two separate lid portions may still obtain the advantages of a modular bridge. Any casket using a handle may enjoy the advantages of the side supports, which serve to allow movement of handle elements without interference with the remains in the body 102. Such side supports also provide structural support to the casket and postural support to the deceased for viewing.

Accordingly, multiple independent features are disclosed herein. In many cases, synergistic combinations of features aid in facilitating a casket that is cost-effective, light weight, strong, and efficient for shipping.

We claim:

1. A casket comprising:

a body structure and at least one lid;

a plurality of side support structures having an angled surface sloping from an interior of a side wall of the body structure to a bottom panel of the body structure, wherein a portion of a moving part of a handle moves in a recess formed below at least a portion of at least a first of the side support structures.

2. The casket of claim 1, wherein at least the first side support structure comprises an elongate tube.

3. The casket of claim 2, wherein the elongate tube has a substantially triangular cross-sectional shape.

4. The casket of claim 3, wherein the elongate tube is formed of a single piece of corrugated paper with at least two lengthwise folds.

5. The casket of claim 2, wherein the elongate tube is formed of a single piece of corrugated paper.

6. A casket comprising:

a body structure and at least one lid;

a plurality of side support structures having an angled surface sloping from an interior of a side wall of the body structure to a bottom panel of the body structure; and a bridge assembly attached to an end of the at least one lid, the bridge assembly including a two end pieces and at least one intermediate piece, and wherein the intermediate piece is configured to be removably attached to the end pieces.

7. The casket of claim 6, wherein a first intermediate piece includes a tab and a first end piece includes a receptacle, the tab insertable into the receptacle.

8. The casket of claim 6, wherein the at least one lid is configured to fit within an interior of the body structure in a first orientation for shipment.

9. The casket of claim 8, wherein the at least one lid is configured to cover the interior of the body structure in a second orientation.

10. A casket comprising:

at least a first lid and a container, wherein the container is configured to receive the lid in a first configuration for shipping, and in a second configuration for funereal purposes, wherein the lid has the same construction in the first configuration and the second configuration;

a plurality of clips configured to support the first lid on the container in the second configuration such that the first lid is located substantially out of, and over, an interior of the container; and wherein the first lid has a lid width and a lid length;

the container has a container width and a container length; and the lid width is less than the container width in the first configuration and the second configuration, and the lid length is less than the container length in the first configuration and the second configuration.

11. The casket of claim 10, wherein each of the clips includes a side wall seating structure and an integrally formed lid receiving element.

12. The casket of claim 10, further comprising a second lid, wherein the first lid and the second lid cooperate to cover the interior of the container.

13. The casket of claim 10, further comprising a plurality of clips configured to support the first lid on the container in the second configuration such that the first lid is located substantially out of, and over, an interior of the container; and wherein:

each of the plurality of clips includes an arm extending in a first direction and an upright extending is a second direction, the second direction different from the first direction, and the arm and the upright are configured such that, in the second configuration, a portion of the first lid is disposed between the upright and an inner surface of the container.

14. The casket of claim 10, wherein the first lid in the first configuration is disposed within the interior.

15. A casket comprising:

at least a first lid and a container, wherein the container is configured to receive the lid in a first configuration for shipping, and in a second configuration for funereal purposes, wherein the lid has the same construction in the first configuration and the second configuration;

a plurality of clips configured to support the first lid on the container in the second configuration such that the first lid is located substantially out of, and over, an interior of the container; and wherein wherein each of the plurality of clips includes a U-shaped structure fitting over a wall of the container.

16. The casket of claim 15, wherein the first lid in the first configuration is disposed within the interior.

17. A casket comprising:

at least a first lid and a container, wherein the container is configured to receive the lid in a first configuration for shipping, and in a second configuration for funereal purposes, wherein the lid has the same construction in the first configuration and the second configuration;

a plurality of clips configured to support the first lid on the container in the second configuration such that the first lid is located substantially out of, and over, an interior of the container; and wherein each of the plurality of clips includes an arm extending in a first direction and an upright extending in a second direction, the second direction different from the first direction.

18. The casket of claim 17, wherein the arm and the upright are configured such that, in the second configuration, a portion of the lid is disposed between the upright and an inner surface of the container.

19. The casket of claim 15, wherein the same construction comprises the lid having the same shape in the first configuration and the second configuration.

20. The casket of claim 17, wherein the first lid in the first configuration is disposed within the interior.

* * * * *